US005797433A

United States Patent [19]

Matas Gabalda

[11] Patent Number: 5,797,433

[45] Date of Patent: Aug. 25, 1998

[54] WEAVING APPARATUS WITH MOTOR CONTROLLED WEFT INSERTION

[75] Inventor: Carlos Matas Gabalda, Ardéche, France

[73] Assignee: ICBT Diederichs, France

[21] Appl. No.: 849,580

[22] PCT Filed: Nov. 21, 1995

[86] PCT No.: PCT/FR95/01528

§ 371 Date: Jun. 3, 1997

§ 102(e) Date: Jun. 3, 1997

[87] PCT Pub. No.: WO96/17985

PCT Pub. Date: Jun. 13, 1996

[30] Foreign Application Priority Data

Dec. 7, 1994 [FR] France ..... 94 14951

[51] Int. Cl.[6] ..... D03D 47/18; D03D 51/00

[52] U.S. Cl. ..... 139/449; 139/1 E

[58] Field of Search ..... 139/446, 1 E, 139/449

[56] References Cited

U.S. PATENT DOCUMENTS

| | | | |
|---|---|---|---|
| 5,158,119 | 10/1992 | Pezzoli et al. | 139/434 |
| 5,276,627 | 1/1994 | Makino et al. . | |
| 5,502,231 | 3/1996 | Bassing | 139/449 |
| 5,642,757 | 7/1997 | Froment et al. | 139/1 E |

FOREIGN PATENT DOCUMENTS

| | | |
|---|---|---|
| 523581 | 3/1993 | European Pat. Off. . |
| 2695414 | 3/1994 | France . |

*Primary Examiner*—Andy Falik
*Attorney, Agent, or Firm*—Wall Marjama & Bilinski

[57] ABSTRACT

A weaving machine in which the weft is inserted by two grippers into a shed from opposite sides of the machine and the pick being beaten by a reed carried by a batten. The grippers and the batten are controlled by electrical motors supplied in parallel by one or more frequency converters and are linked together by a synchronizing mechanism.

3 Claims, 1 Drawing Sheet

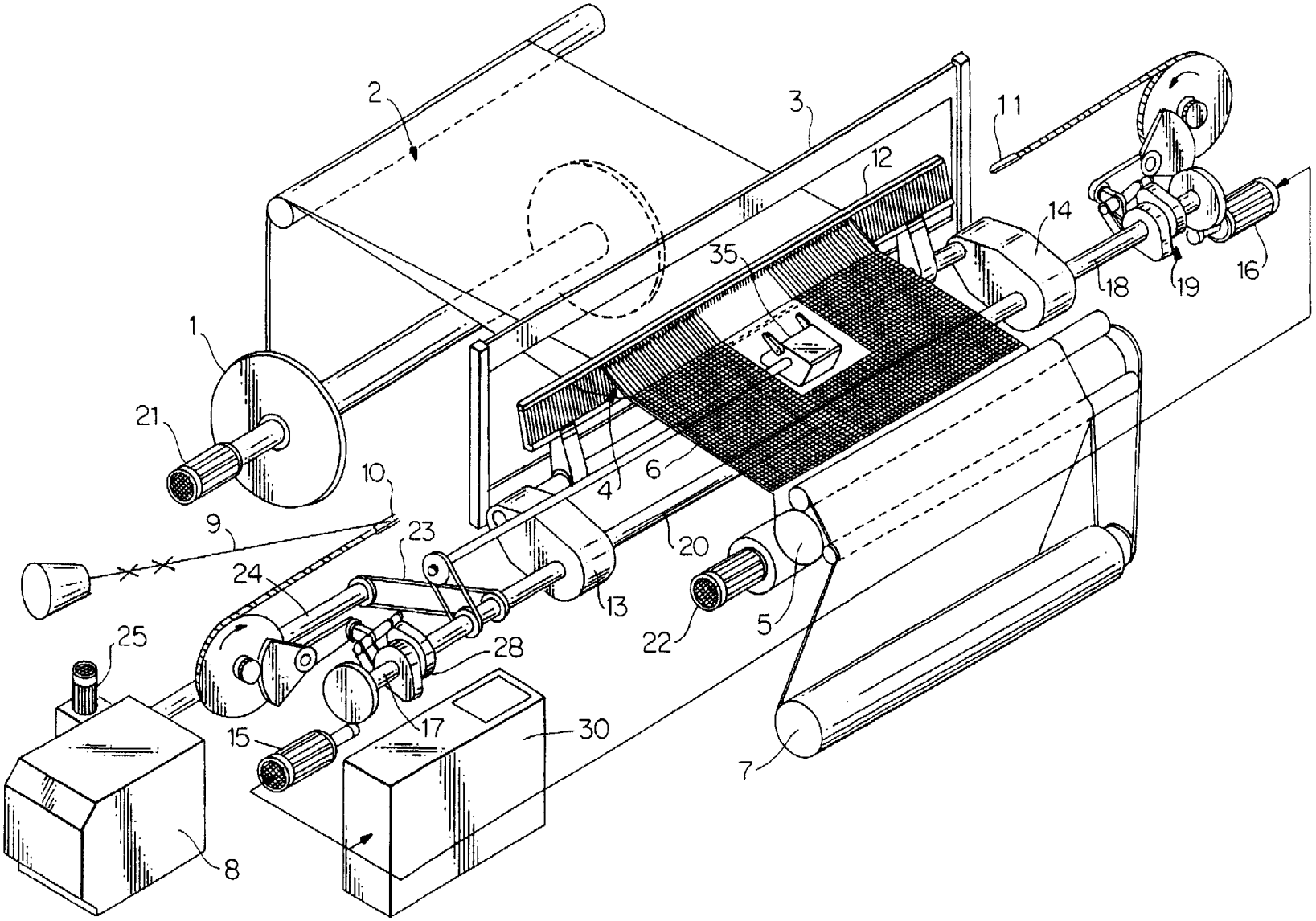
16
19
18
14
11
12
3
35
2
1
21
9
10
23
24
28
17
15
25
8
30
4
6
20
22
13
5
7

WEAVING APPARATUS WITH MOTOR CONTROLLED WEFT INSERTION

BACKGROUND OF THE INVENTION

The present invention relates to an improvement made to weaving machines and, more particularly, to a new way of ensuring drive and synchronization between the various means which the machine comprises, in order to produce a fabric.

In the rest of the description, the invention will be described with regard to a weaving machine, in which the insertion of the weft is carried out by means of two grippers introduced simultaneously into the shed from each side of the machine, one gripper serving for delivering the weft yarn, taken from a bobbin located on one side of the machine, as far as the middle of the width of the latter, where there is then a transfer to the second gripper which, during its retraction, delivers the yarn on the side opposite to the feed side, the displacements of the said grippers within the shed being ensured by an assembly commonly referred to by the expression "rapier or flexible band".

It is clear that this is not limiting, and that the invention could equally be used for other types of weaving machine employing means other than positive grippers for ensuring the insertion of the weft.

The production of a fabric involves:

on the one hand, ensuring the unrolling of the lap of warp yarns, the formation of the shed and the winding-up of the fabric produced, and;

on the other hand, inserting the weft yarn when the shed is open and of beating it up against the last pick made by means of a reed carried by a batten.

Hitherto, for executing the control and synchronization of the various elements which make it possible to carry out these operations, weaving machines have comprised a single motor which, by means of a clutch/brake assembly, drives in rotation a driveshaft, known as a "main shaft", which extends over the entire width of the machine and from which mechanical connections make it possible to ensure that the various members of the machine are driven in synchronism.

From a practical point of view, such a concept is satisfactory, but it nevertheless has the disadvantages that it requires a high-power motor capable of transmitting a high torque which, as an indication, is of the order of 70 m.kg for a weaving machine which makes it possible to obtain articles having a width of 2 to 4 meters and which rotates at a speed of 400 to 500 strokes per minute.

Moreover, the transmission of movement to the various members (warp-yarn beam, winding-up system, advance and retraction of the insertion grippers, control of the batten) utilizing mechanical transmissions appreciably complicates the structure of these machines.

A solution making it possible to solve all these problems has been found, this being the subject of the present invention.

SUMMARY OF THE INVENTION

In general terms, therefore, the invention relates to an improvement made to weaving machines, in which the insertion of the weft is carried out by means of two grippers introduced simultaneously into the shed from each side of the machine, one gripper serving for delivering the weft yarn, taken from a bobbin located on one side of the machine, as far as the middle of the width of the latter, where there is then a transfer to the second gripper which, during its retraction, delivers the yarn on the side opposite to the feed side, the pick put in place subsequently being beaten up against the last pick of the fabric by means of a reed carried by a batten.

The invention is characterized in that the control of the weft insertion means and of the batten is carried out by means of two electric motors arranged on each side of the machine:

each motor driving a machine shaft controlling the weft insertion means and the batten-carrying housing located on the same side as the said motor;

these two motors being supplied in parallel by means of one or more frequency converters and being connected to one another by synchronizing means; such synchronizing means consist in a simple way of a rigid connection connecting the two machine shafts to one another.

Although it is possible to consider ensuring the control of the warp unwinder and of the fabric winder, on the one hand, and of the displacement of the frames ensuring the formation of the shed, on the other hand, by means of mechanical connections with the two abovementioned driveshafts, according to a preferred embodiment of the invention each of these elements is likewise controlled by means of an electric motor. In such a case, the synchronization of all the motors which the weaving machine comprises is obtained by means of a central control unit.

By virtue of such a concept, in which the control of the various members of the weaving machine is carried out by means of specific motors associated with each means, it is possible not only to eliminate a large number of mechanical connections required by conventional machines, in which all the movements are taken off from a main shaft controlled by a single motor, but also to obtain a much more rapid increase in speed of the machine, the torque to be transmitted being much lower.

However, the invention and the advantages which it affords will be better understood from the exemplary embodiment which is given below as a non-limiting indication and which is illustrated by the single figure which is a diagrammatic perspective view of a weaving machine produced according to the invention.

These and other objects of the invention will be explained in further detail below in association with the accompanying drawing which is a perspective view of a weaving machine embodying the teachings of present inventions.

BRIEF DESCRIPTION OF THE DRAWING

The present invention will be explained in conjunction with the associated drawing which is a perspective view of a weaving machine containing a pair of grippers for delivering a weft into a shed from opposite sides of the machine wherein the grippers and the batten are controlled by electric motors that are linked together by a synchronizing mechanism.

DESCRIPTION OF THE INVENTION

Referring to the accompanying diagram, the weaving machine according to the invention is therefore composed, like all weaving machines, of a beam (1) of warp yarns (2), of heald frames (3) (only one being indicated in the diagram) or Jacquard system for the control of the warp yarns, making it possible to ensure the formation of the shed (4), of a take-up system (5) for the formed fabric (6) and of a roller (7) for winding up the said fabric.

The control of the warp yarns is obtained by all suitable means, such as, for example, a dobby (8) or a Jacquard mechanism.

The weft (9) is stored on a bobbin arranged on one side of the machine. The machine may, of course, be designed to make it possible to insert a plurality of wefts of different colours and/or types according to a rhythm depending on the fabric to be produced. In such an instant, weft yarns may be fed in accordance with the teachings of FR-A-2,695,414.

Insertion of the weft yarn (9) is obtained by means of an assembly comprising two positive grippers (10, 11) arranged on each side of the machine and introduced simultaneously into the shed (4), the gripper (10) driving the weft thread (9) and transferring this end of the latter to the gripper (11) in the middle of the shed by transfer means (35), this gripper (11) delivering the weft on the other side of the machine. The weft introduced is beaten up against the last pick of the fabric (6) by means of a reed (12) mounted on a batten controlled by two housings (13, 14).

Since all the abovementioned means are conventional means, they will not be described in detail for the sake of simplification.

According to the invention, the means (10, 11) allowing the insertion of the weft (9) and the reed (4) carried by the batten are controlled by means of two electric motors (15, 16) arranged on each side of the machine.

The motor (15) drives the machine shaft (17) which controls the means (28) (cam boxes) controlling the displacements of the insertion gripper (10), the batten-carrying housing (13) located on the left-hand side of the machine and, where appropriate, the mechanism for forming the shed, the motor (16) located on the right-hand side driving a second shaft (18) as well as the means (19) (cam boxes) controlling the displacements of the gripper (11) and the batten-carrying housing (14).

These two motors (15, 16) are, for example, motors of the asynchronous type. They are supplied in parallel by means of a frequency converter (30) and are connected to one another by synchronizing means. If appropriate, each motor could be supplied by a frequency converter.

In the exemplary embodiment illustrated in the accompanying diagram, such synchronizing means consist of a rigid connection (20) connecting the two shafts (17, 18) to one another.

Moreover, in the example illustrated, the beam (1) and the take-up system (5) for the formed fabric are controlled by two individual motors (21) and (22).

Finally, although it is possible to consider controlling members for the formation of the shed, for example a dobby, by means of a mechanical connection (belt (23)/shaft (24)), according to a preferred embodiment this control is obtained by means of an individual motor (25).

Such a machine is put into operation as follows.

When the machine is started up, the various members being at their starting point, an increase in speed of the motors (15, 16) is carried out over a plurality of revolutions of the machine, with the unwinder (21), the take-up (22) and the dobby (8) being at a standstill, the weft (9) is then offered to the insertion gripper (10), and, simultaneously, the motors (21, 22, 25) are actuated, allowing a normal weaving process.

After a stop, which is deliberate or the result of a break, when the machine is started up again, where appropriate after the repair of the yarn, all the motors are actuated in order to execute a return in reverse amounting to two revolutions. When this has taken place, the motors (15, 16) are started up and are accelerated over one revolution, a new pick (9) is then inserted at the second revolution, and, simultaneously, the motors (21, 22, 25) controlling the warp unwinder and the dobby are reactivated.

I claim:

1. Weaving machine, in which the insertion of a weft (9) is carried out by means of two grippers (10, 11) introduced simultaneously into a shed (4) from each side of the machine, one gripper (10) serving for delivering weft yarn, taken from a bobbin located on one side of the machine, as far as the middle of the width of the shed where there is then a transfer to a second gripper (11) which, during a retraction thereof delivers yarn on a side opposite to a feed side, a pick put in place subsequently and being beaten up against a last pick of the fabric by means of a reed carried by a batten (12), characterized in that the control of the grippers (10, 11) and of the batten (12) is carried out by two electric motors (15, 16) arranged on each side of the machine:

each motor (15, 16) driving a machine shaft (17, 18) controlling the grippers (10, 11) and batten-carrying housing (13, 14) located on the same side as the said motor;

said two motors (15, 16) being supplied in parallel by means of one or more frequency converters (30) and being connected to one another by synchronizing means.

2. Weaving machine according to claim 1, characterized in that the synchronizing means consist of a rigid connection (20) connecting the two machine shafts (17, 18) to one another.

3. Weaving machine according to claim 1, characterized in the a warp unwinder (1), a take-up for fabric (6) and means for ensuring the formation of the shed are independently controlled by separate other motor means (21, 22, 25).

* * * * *